US008827396B2

(12) United States Patent
Oguchi

(10) Patent No.: US 8,827,396 B2
(45) Date of Patent: Sep. 9, 2014

(54) INK-JET RECORDING APPARATUS

(71) Applicant: Brother Kogyo Kabushiki Kaisha, Nagoya (JP)

(72) Inventor: Tomoya Oguchi, Aichi-ken (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/839,433

(22) Filed: Mar. 15, 2013

(65) Prior Publication Data

US 2014/0085362 A1 Mar. 27, 2014

(30) Foreign Application Priority Data

Sep. 25, 2012 (JP) ..... 2012-210268

(51) Int. Cl.
*B41J 2/195* (2006.01)
*B41J 2/175* (2006.01)

(52) U.S. Cl.
CPC ..... *B41J 2/17566* (2013.01)
USPC ..... 347/7; 347/14; 347/19

(58) Field of Classification Search
USPC ..... 347/6, 7, 14, 19, 84–87
See application file for complete search history.

(56) References Cited

U.S. PATENT DOCUMENTS

| | | | | |
|---|---|---|---|---|
| 5,764,253 | A | 6/1998 | Uchikata et al. | |
| 6,976,746 | B2 * | 12/2005 | Shimamura | 347/7 |
| 7,284,807 | B2 * | 10/2007 | Ishihara | 347/7 |
| 2007/0165065 | A1 | 7/2007 | Tamai et al. | |

FOREIGN PATENT DOCUMENTS

| | | | |
|---|---|---|---|
| JP | H06-210874 | A | 8/1994 |
| JP | 2004-136550 | A | 5/2004 |
| JP | 2006-159465 | A | 6/2006 |

* cited by examiner

*Primary Examiner* — Juanita D Jackson
(74) *Attorney, Agent, or Firm* — Merchant & Gould PC

(57) ABSTRACT

An ink-jet recording apparatus, including: a recording head; a discharge mechanism configured to perform a discharge operation; an absorbing member configured to absorb discharged ink; and a controller configured to: make a judgment as to whether or not to allow the discharge mechanism to perform the discharge operation every time a discharge timing comes; calculate a waste-liquid amount in a specific time period from a current discharge timing to a time point that precedes by a prescribed time from the current discharge timing, the waste-liquid amount indicative of an amount of the ink discharged in the discharge operation; allow the discharge operation when the calculated waste-liquid amount is smaller than an upper-limit value of an ink-absorption amount, in the specific time period, of the absorbing member; and inhibit the discharge operation at the current discharge timing when the calculated waste-liquid amount becomes equal to or larger than the upper-limit value.

22 Claims, 12 Drawing Sheets

INK-JET RECORDING APPARATUS

CROSS REFERENCE TO RELATED APPLICATION

The present application claims priority from Japanese Patent Application No. 2012-210268, which was filed on Sep. 25, 2012, the disclosure of which is herein incorporated by reference in its entirety.

BACKGROUND OF THE INVENTION

1. Field of the Invention

The present invention relates to an ink-jet recording apparatus in which waste ink discharged from a recording head is absorbed by an absorbing member.

2. Description of Related Art

There is conventionally known an ink-jet recording apparatus in which waste ink that is not ejected to a recording medium is discharged from a recording head and is absorbed by an absorbing member, such as a sponge, accommodated in a waste-liquid tank.

Further, there is known an image forming apparatus configured to detect whether or not a waste-liquid tank has become full of waste ink for preventing the waste ink from leaking from the waste-liquid tank. To be more specific, in the image forming apparatus, an accumulation-status counter in a non-volatile memory is configured to be incremented every time a recovering operation is performed, and a signal indicating that the waste-liquid tank has become full is outputted when a count value of the counter exceeds a reference value.

SUMMARY OF THE INVENTION

The image forming apparatus described above, however, has the following problem. When a discharge amount of the waste ink in a short time period becomes large, a speed at which the waste ink flows into the waste-liquid tank exceeds a permeation speed of the waste ink in the absorbing member, thereby causing a risk of leakage of the waste ink from the waste-liquid tank.

The present invention has been made in view of the problem described above. It is therefore an object of the invention to provide an ink-jet recording apparatus in which leakage of discharged waste ink can be suppressed.

The object indicated above may be attained according to a first aspect of the invention which provides an ink-jet recording apparatus, comprising:

a recording head configured to perform image recording by ejecting ink to a recording medium;

a discharge mechanism configured to perform a discharge operation for discharging the ink from the recording head;

an absorbing member configured to absorb the ink discharged by the discharge mechanism; and a controller configured to make a judgment as to whether or not to allow the discharge mechanism to perform the discharge operation every time a discharge timing comes and to control the discharge mechanism based on a result of the judgment;

wherein the controller is configured to:

calculate a waste-liquid amount in a specific time period from a current discharge timing to a time point that precedes by a prescribed time from the current discharge timing, the waste-liquid amount indicative of an amount of the ink discharged from the recording head in the discharge operation;

allow the discharge mechanism to perform the discharge operation when the calculated waste-liquid amount is smaller than an upper-limit value of an ink-absorption amount, in the specific time period, of the absorbing member; and inhibit the discharge mechanism from performing the discharge operation at the current discharge timing when the calculated waste-liquid amount becomes equal to or larger than the upper-limit value.

The object indicated above may be attained according to a second aspect of the invention which provides an ink-jet recording apparatus, comprising:

a recording head configured to perform image recording by ejecting ink to a recording medium;

a discharge mechanism configured to perform a discharge operation in which the ink is discharged from the recording head;

an absorbing member configured to absorb the ink discharged by the discharge mechanism; and a controller configured to make a judgment as to whether or not to allow the discharge mechanism to perform the discharge operation every time a discharge timing comes and to control the discharge mechanism based on a result of the judgment;

wherein the controller is configured to:

calculate a waste-liquid amount in a specific time period from a current discharge timing to a time point that precedes by a prescribed time from the current discharge timing, the waste-liquid amount indicative of an amount of the ink discharged from the recording head in the discharge operation;

allow the discharge mechanism to perform the discharge operation in which a discharge speed of the ink is set at a first speed when the calculated waste-liquid amount is smaller than an upper-limit value of an ink-absorption amount, in the specific time period, of the absorbing member; and allow the discharge mechanism to perform the discharge operation in which the discharge speed of the ink is set at a second speed lower than the first speed when the calculated waste-liquid amount becomes equal to or larger than the upper-limit value.

The object indicated above may be attained according to a third aspect of the invention which provides an ink-jet recording apparatus, comprising:

a recording head configured to perform image recording by ejecting ink to a recording medium;

a discharge mechanism configured to perform a discharge operation in which the ink is discharged from the recording head;

an absorbing member configured to absorb the ink discharged by the discharge mechanism; and a controller configured to make a judgment as to whether or not to allow the discharge mechanism to perform the discharge operation every time a discharge timing comes and to control the discharge mechanism based on a result of the judgment;

wherein the controller is configured to allow the discharge mechanism to perform the discharge operation at a current discharge timing, when an interval between: the current discharge timing; and an immediately preceding discharge timing which immediately precedes the current discharge timing and at which the discharge operation was performed is shorter than a prescribed time.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which:

FIG. 5A shows a state in which a cap 72 is in a second posture and FIG. 5B shows a state in which the cap 72 is in a first posture;

DETAILED DESCRIPTION OF THE EMBODIMENTS

There will be hereinafter described embodiments of the present invention with reference to the drawings. It is to be understood that the following embodiments are described for illustrative purpose only and that the invention may be otherwise embodied with various changes and modifications without departing from the scope of the invention. In the following description, an up-and-down direction 7 is defined on the basis of a state in which a multi-function device (MFD) 10 is placed in its operative position (i.e., a state of the MFD 10 shown in FIG. 1), a front- and rear direction 8 is defined by regarding, as a front side, a side of the MFD 10 on which a main-body opening 13 is provided, and a left-and-right direction 9 is defined in a state in which the MFD 10 is seen from the front side.

<MFD 10>

Figure 1:
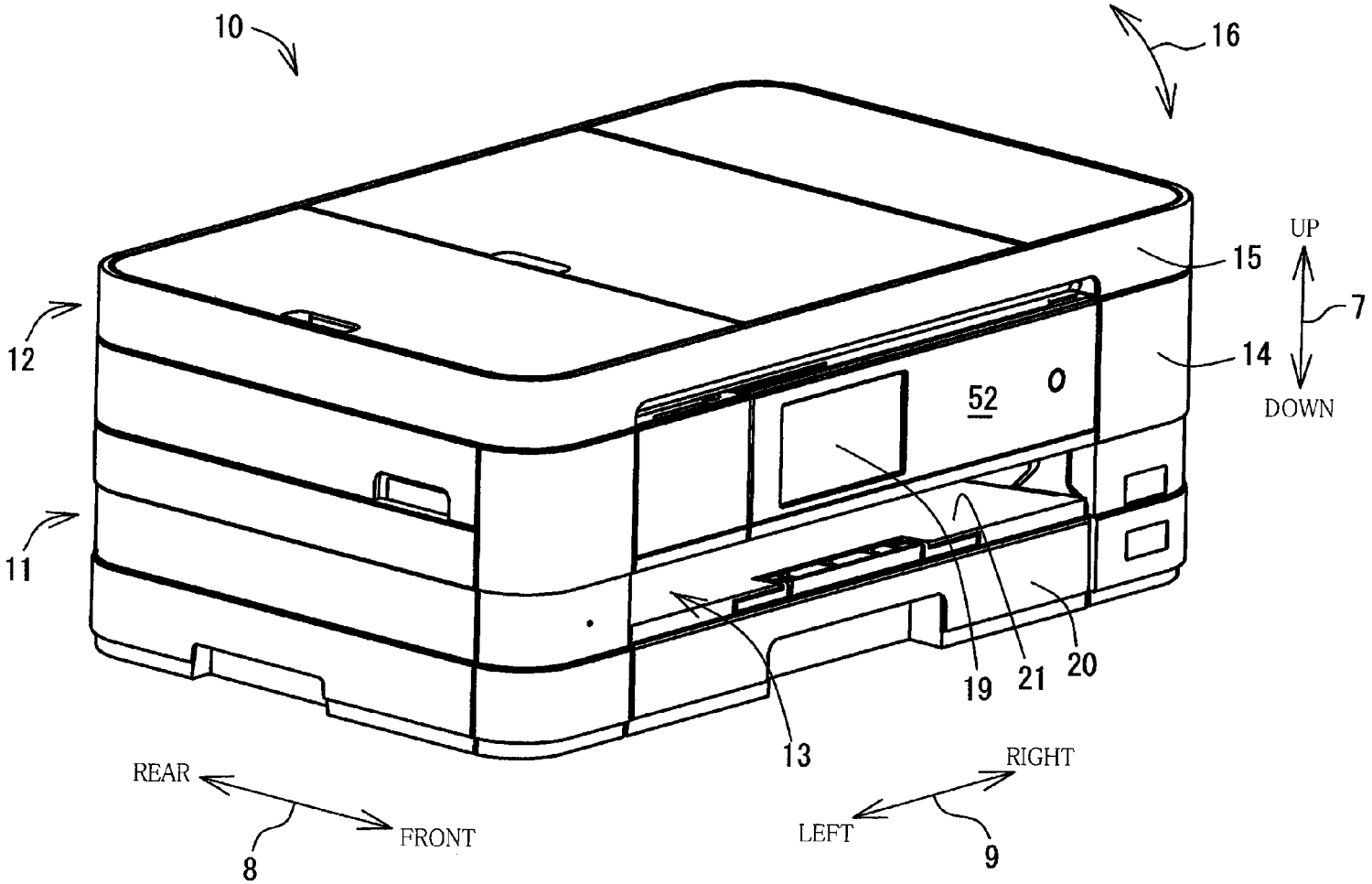
FIG. 1 is an external perspective view showing a multi-function device 10.

As shown in FIG. 1, the MFD 10 has a substantially rectangular parallelepiped shape with a low profile. The MFD 10 has, at its upper portion, a scanner portion 12 configured to read, by an image sensor, an image recorded on a document such as a recording sheet so as to obtain image data. The scanner portion 12 has a scanner housing 15 that covers the image sensor and the like as constituent components of the scanner portion 12. The scanner portion 12 is the so-called flatbed scanner. The scanner housing 15 is supported by a printer housing 14 such that its front-side portion is pivotable upward and downward about its rear-side end portion, namely, such that the scanner portion 12 is pivotable in directions shown by the double-headed arrow 16 in FIG. 1. Here, a detailed explanation of the scanner portion 12 is dispensed with.

The MFD 10 has, below the scanner portion 12, a printer portion 11 (as one example of an ink-jet recording apparatus of the invention) configured to record an image on a recording sheet (as one example of a recording medium of the invention). The printer portion 11 has the printer housing 14 having the main-body opening 13 formed in a front face of the printer housing 14. A sheet-supply tray 20 is provided so as to be insertable and removable through the main-body opening 13 in the front-and-rear direction 8. The recording sheets in a desired size are placed or stacked on the sheet-supply tray 20.

The MFD 10 further has an operation panel 19 on its front face 52. The operation panel 19 is a user interface to receive various instructions from a user. That is, the MFD 10 operates based on instructions from the user obtained through the operation panel 19.

The printer portion 11 includes: a sheet-supply roller 25 (FIG. 6), a conveyance roller 61 (FIG. 6), and a discharge roller 62 (FIG. 6) configured to convey the recording sheet in a conveyance direction; a recording section 24 (FIG. 2) configured to record an image on the recording sheet conveyed in a conveyance passage 23 on the basis of image data read from a document by the scanner portion 12 or other data; and a board 80 (FIG. 2) on which is mounted a controller 130 (FIG. 6) configured to control overall operations of the MFD 10.

<Conveyance Passage 23>

The conveyance passage 23 is a passage that extends upward from a rear end portion of the sheet-supply tray 20, makes a U-turn, then extends frontward through a position under a region in which the recording section 24 is movable, and finally reaches a sheet-discharge tray 21. The conveyance passage 23 is a space defined by two guide members (not shown) that are opposed to each other with a predetermined distance therebetween.

<Sheet-Supply Roller 25, Conveyance Roller 61, and Discharge Roller 62>

The sheet-supply roller 25 is configured to supply the uppermost one of the recording sheets stacked on the sheet-supply tray 20 to the conveyance passage 23. The conveyance roller 61 is disposed on the upstream side of the recording section 24 in the conveyance direction and is configured to convey the recording sheet supplied to the conveyance passage 23 by the sheet-supply roller 25 toward the downstream side. The discharge roller 62 is disposed on the downstream side of the recording section 24 in the conveyance direction and is configured to discharge, to the sheet-discharge tray 21, the recording sheet on which an image has been recorded by the recording section 24. The sheet-supply roller 25, the conveyance roller 61, and the discharge roller 62 are driven by a conveyance motor 101 (FIG. 6) according to the control of the controller 130.

<Recording Section 24>

Figure 4:
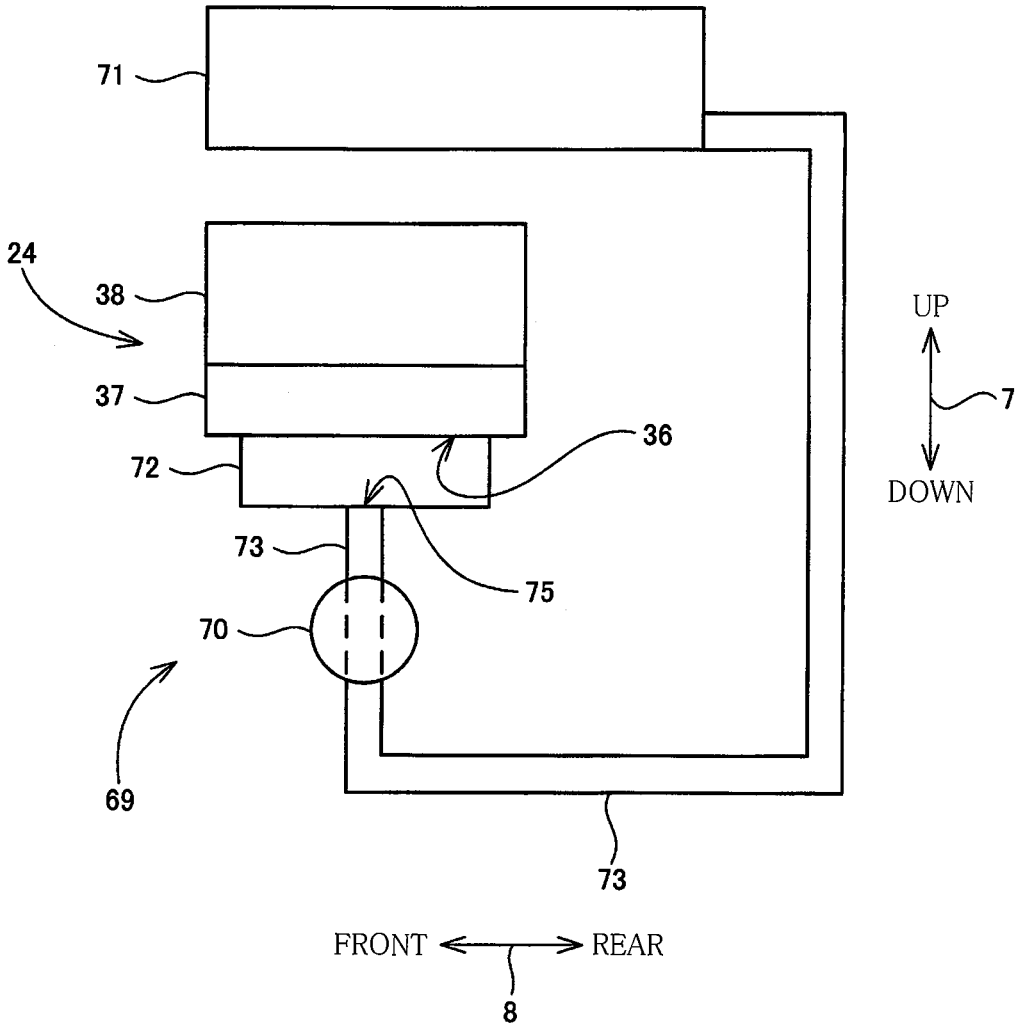
FIG. 4 is a right side view schematically showing the waste-liquid reservoir 71, a recording section 24, and a purging mechanism 69.

As shown in FIG. 4 and FIG. 5, the recording section 24 includes a recording head 37 of an ink-jet type (FIGS. 4 and 5) and a carriage 38 on which the recording head 37 is mounted. As described above, the recording section 24 is disposed between the conveyance roller 61 and the discharge roller 62 in the front-and-rear direction 8. The carriage 38 is driven by a carriage drive motor 103 according to the control of the controller 130. The carriage 38 is supported by a pair of guide rails 43, 44 (that will be explained) so as to be movable on a plane parallel to a recording surface of the recording sheet on which an image is to be recorded, in the left-and-right direction 9 orthogonal to the front-and-rear direction 8 that is parallel to the conveyance direction of the recording sheet.

The recording head 37 is disposed below the carriage 38. A plurality of nozzles (not shown) are formed in a lower surface of the recording head 37. The nozzles are open in the lower surface of the recording head 37 so as to be exposed. That is, the recording head 37 has a nozzle surface 36 (FIG. 4) in which the nozzles are formed.

Inks of different colors are supplied to the recording head 37 from respective ink cartridges (not shown) mounted on a cartridge mount 41 (FIG. 2) that will be explained. During the movement of the carriage 38, the inks of different colors are selectively ejected from the nozzles as minute ink droplets. Thus, an image is formed on the recording sheet that is being conveyed in the conveyance passage 23.

The pair of guide rails 43, 44 extend in the left-and-right direction 9 and are disposed so as to be spaced apart from each other in the front-and-rear direction 8. The guide rails 43, 44 are attached to a frame 68 of the printer portion 11 and are supported by the frame 68. The carriage 38 is supported by the guide rails 43, 44 such that the carriage 38 bridges the guide rails 43, 44 so as to be movable in the left-and-right direction 9. A waste-liquid reservoir 71 is attached to the frame 68. More specifically, the waste-liquid reservoir 71 is supported by the frame 68 at a position at which the waste-liquid reservoir 71 covers a part of the rear-side guide rail 43 and a part of a reciprocating movement range of the carriage 38.

<Cartridge Mount 41>

Figure 2:
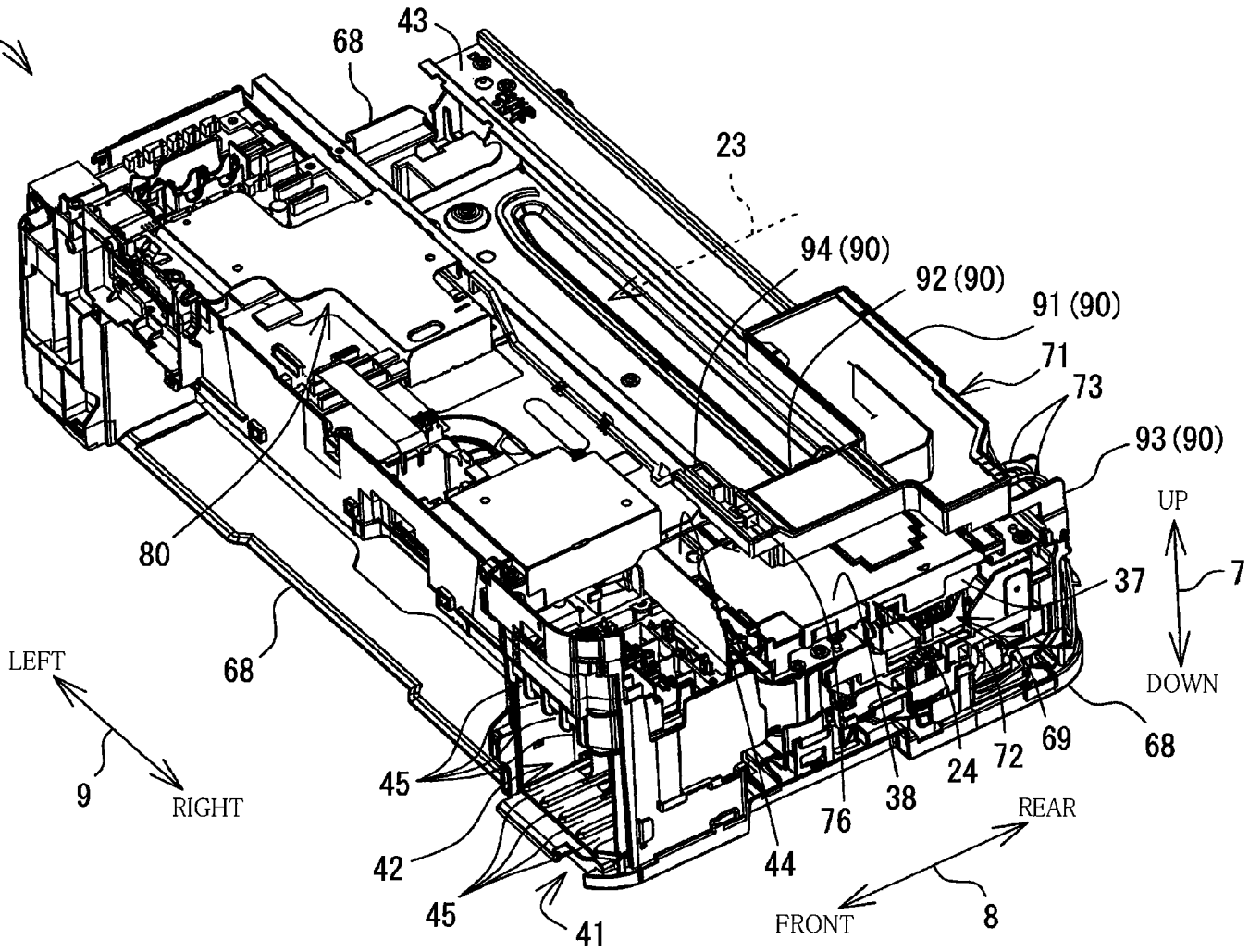
FIG. 2 is a perspective view showing an inside of a printer portion 11 when seen from a front right upper side thereof.

As shown in FIG. 2, the cartridge mount 41 is disposed at a lower right portion on the front face 52 of the printer portion 11. The cartridge mount 41 is a substantially parallelepiped, box-like member having an opening 42. The ink cartridges (not shown) are inserted into and removable from the cartridge mount 41 along guide grooves 45 formed on top and bottom surfaces of the cartridge mount 41. Four ink cartridges respectively corresponding to four colors, i.e., cyan, magenta, yellow, and black, are mountable to the cartridge mount 41 in the present embodiment. Each ink stored in the corresponding ink cartridge is supplied to the recording head 37 through a corresponding ink needle (not shown) provided on a rear inner surface of the cartridge mount 41 and a corresponding ink tube (not shown) that extends from the ink needle to the recording head 37.

<Waste-Liquid Reservoir 71>

Figure 3:
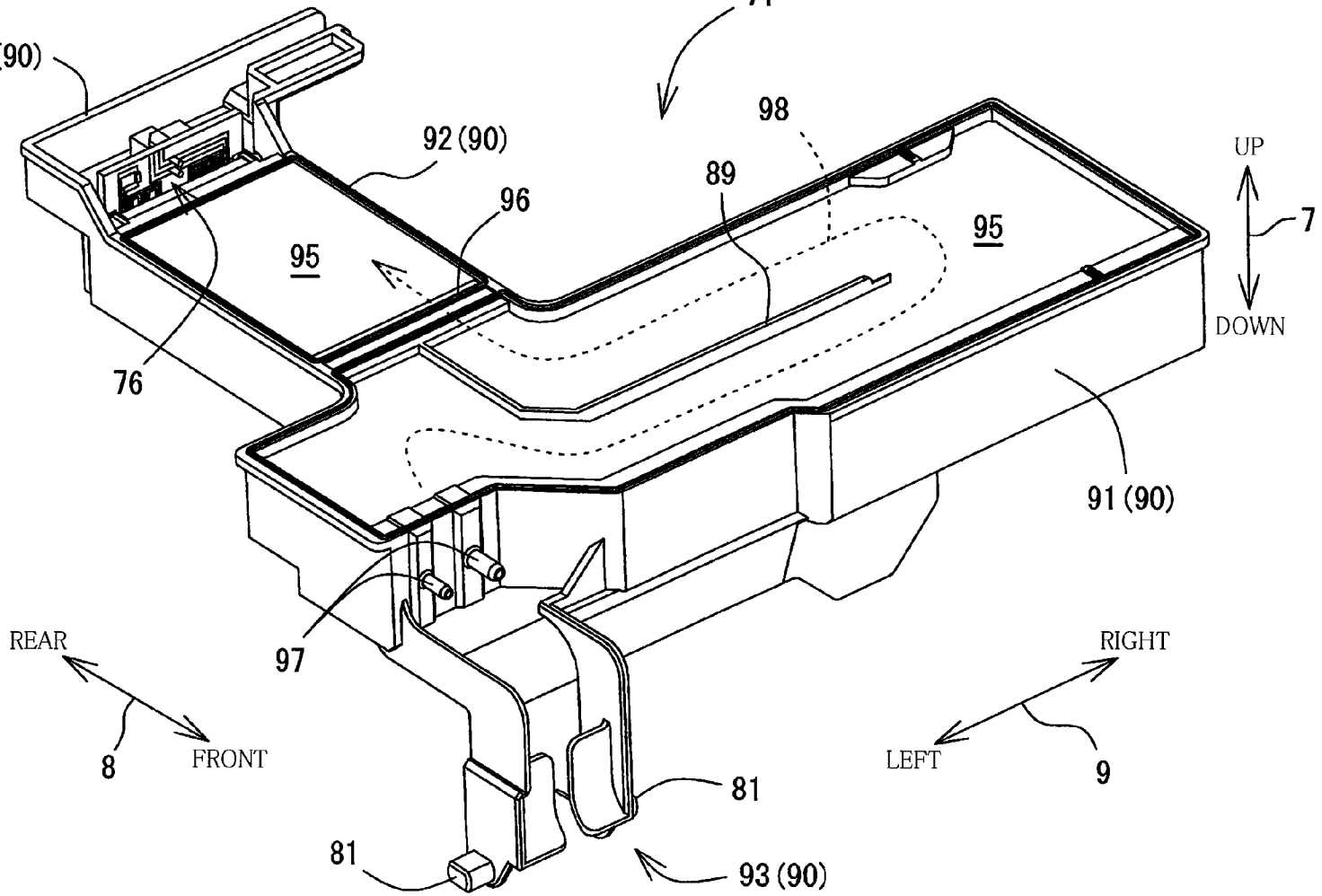
FIG. 3 is a perspective view showing a waste-liquid reservoir 71.

The waste-liquid reservoir 71 (as one example of an absorbing-member accommodator of the invention) is for storing ink discharged by a purging mechanism 69 (as one example of a discharge mechanism of the invention). As shown in FIG. 3, the waste-liquid reservoir 71 has a main body 90 having a generally T-like contour in plan view and ink absorbing members 95 (as one example of an absorbing member of the invention) attached to the main body 90.

As shown in FIG. 3, the main body 90 includes a first portion 91, a second portion 92, a third portion 93, and a fourth portion 94. The first portion 91 extends along the left-and-right direction 9 so as to constitute the horizontal line of the character T. The second portion 92 extends from the middle position of the first portion 91 along the front-and-rear direction 8 so as to constitute the vertical line of the character T. The third portion 93 is provided on one side of the first portion 91 remote from the second portion 92, namely, on the front side of the main body 90, so as to be adjacent to the first portion 91. The fourth portion 94 is provided on one side of the second portion 92 remote from the first portion 91, namely on the rear side of the main body 90, so as to be adjacent to the second portion 92.

Each of the first portion 91 and the second portion 92 is a box-like member opening upward, as shown in FIG. 3. In respective inner spaces of the first portion 91 and the second portion 92, the ink absorbing members 95 are inserted from the upper side of the portions 91, 92. In other words, the ink absorbing members 95 are accommodated in the waste-liquid reservoir 71 such that a part of each ink absorbing member 95, namely, the upper surface thereof, is in an exposed state. Here, the "exposed state" means that the ink absorbing members 95 and the recording section 24 are present or disposed in a non-partitioned common space. In this state, there is a possibility that the ink leaked from the ink absorbing members 95 may contact the recording section 24. Each ink absorbing member 95 is formed of a porous material such as foamed polyurethane. The ink enters pores of the porous material of the ink absorbing members 95 and is thereby absorbed by the ink absorbing members 95.

A bent plate 89 is provided on a bottom surface of the first portion 91 so as to extend upright therefrom. The bent plate 89 extends frontward from the vicinity of a boundary between the first portion 91 and the second portion 92 and is bent rightward at a substantially middle position of the first portion 91 in the front-and-rear direction 8. A plate 96 is provided so as to extend upright in the vicinity of the boundary between the first portion 91 and the second portion 92. The plate 96 is connected to one end of the bent plate 89 so as to extend in the left-and-right direction 9. The plate 96 is configured to permit the ink entered the first portion 91 to flow into the second portion 92 on the right side of the connection of the plate 96 and the bent plate 89. On the other hand, the plate 96 is configured to inhibit the ink entered the first portion 91 from flowing into the second portion 92 on the left side of the connection of the plate 96 and the bent plate 89. In other words, the ink entered the waste-liquid reservoir 71 through connectors 97 (FIG. 3) for a pump tube 73 is absorbed by the ink absorbing members 95, is spread along an arrow-headed broken-line 98 in FIG. 3, and finally reaches a rear end portion of the second portion 92.

The third portion 93 is formed so as to extend downward from a front-side left end portion of the first portion 91. A pair of protruding portions 81 protrude in the left-and-right direction from a distal end portion (lower end portion) of the third portion 93. The protruding portions 81 are to be inserted into respective holes (not shown) formed in the frame 68 of the printer portion 11. In the arrangement, the waste-liquid reservoir 71 is pivotably supported with respect to the frame 68 about an axis line connecting the protruding portions 81, namely, an axis line extending in the left-and-right direction 9.

The fourth portion 94 is formed on a back surface of the second portion 92. As shown in FIG. 3, a sensing electrode 76 (as one example of a sensor of the invention) is disposed at a boundary between the fourth portion 94 and the second portion 92. The sensing electrode 76 is disposed such that its sensing surface faces the second portion 92 and a backside of the sensing surface faces the fourth portion 94. Electric wires (not shown) extend from the backside of the sensing surface of the sensing electrode 76 toward the board 80. The electric wires electrically connect the sensing electrode 76 and the controller 130 that is mounted on the board 80.

The sensing electrode 76 outputs a HIGH level signal, namely, a signal whose level is not lower than a threshold, in a state in which the ink reaches the sensing electrode 76, in other words, when an amount of the ink stored in the waste-liquid reservoir 71 exceeds a prescribed reference amount. On the other hand, the sensing electrode 76 outputs a LOW level signal (whose level is less than the threshold) in a state in which the ink does not yet reach the sensing electrode 76, in other words, when the amount of the ink stored in the waste-liquid reservoir 71 is not larger than the reference amount. In this respect, the sensing electrode 76 is preferably disposed such that the HIGH level signal is outputted in a state in which there remains, in the waste-liquid reservoir 71, a certain degree of room for storing the ink. That is, a purging operation (that will be later explained) can be preferably performed prescribed times (e.g., two times) even after the HIGH level signal is outputted from the sensing electrode 76.

It is noted that the shape and the location of the waste-liquid reservoir 71 are not limited to those illustrated above. The waste-liquid reservoir 71 may have any shape that allows the ink absorbing members 95 to be held and may be positioned at any arbitrary location in the MFD 10.

<Purging Mechanism 69>

The purging mechanism 69 is configured to perform the purging operation in which air bubbles and foreign substances are removed, together with the ink, by suction from the nozzles and so on of the recording head 37. As shown in FIGS. 2 and 4, the purging mechanism 69 includes: a cap 72 configured to cover the nozzles of the recording head 37; a pump 70 configured to be connected to the cap 72 for sucking the ink from the recording head 37; a lift-up mechanism 74 (FIG. 5) configured to move the cap 72 upward for bringing the cap into close contact with the recording head 37 and to move the cap 72 downward for separating the cap 72 away from the recording head 37; and the pump tube 73 configured to connect the pump 70 and the waste-liquid reservoir 71.

<Cap 72>

The cap 72 is disposed in a region of the conveyance passage 23 outside a sheet-passing region thereof. More specifically, the region in which the cap 72 is disposed is located at an end portion of the conveyance passage 23 in the left-and-right direction 9 through which the recording sheet does not pass. In other words, the cap 72 is disposed at a position at which the cap 72 is opposed to the nozzle surface 36 when the carriage 38 is moved to a position at which the carriage 38 is not opposed to the recording sheet. The cap 72 is constituted by an elastic member such as rubber. The cap 72 is configured to be moved by the lift-up mechanism 74 to come into close contact with the nozzle surface 36 of the recording head 37 held by the carriage 38 that has moved to a position at which the carriage 38 is opposed to the cap 72 and to thereby cover the nozzle surface 36 with a space formed therebetween. A suction hole 75 is formed on the bottom of the cap 72.

<Pump 70>

The pump 70 is in communication with the suction hole 75 of the cap 72 via the pump tube 73. The pump 70 is a tube pump of a rotary type, for instance. The pump 70 is driven by the conveyance motor 101 (FIG. 6) according to the control of the controller 130, whereby the ink in the nozzles is discharged to the waste-liquid reservoir 71 through the cap 72 and the pump tube 73.

<Lift-Up Mechanism 74>

As shown in FIG. 5 the lift-up mechanism 74 in the present embodiment is constituted by a first frame 56, a second frame 57, and a slide cam 60. As long as the lift-up mechanism 74 is configured to move the cap 72 upward and downward, its structure is not limited to that described below.

The first frame 56 is formed to have a box-like shape and is supported by the slide cam 60. The slide cam 60 is supported at its lower surface by the second frame 57. The second frame 57 is disposed at the above-described frame 68. It is noted that the second frame 57 may be a part of the frame 68.

The slide cam 60 has guide surfaces that contact a lower surface of the first frame 56. The guide surfaces include a first guide surface 111, a second guide surface 112, and an inclined surface 113 that connects the first guide surface 111 and the second guide surface 112. The height level of the first guide surface 111 is lower than that of the second guide surface 112. The inclined surface 113 is inclined such that its height level changes from the height level of the first guide surface 111 to the height level of the second guide surface 112.

The first frame 56 is configured to slide in the left-and-right direction 9 while being guided by the first guide surface 111, the second guide surface 112, and the inclined surface 113. The first frame 56 is configured to slide in the left-and-right direction 9 and to also move in the up-and-down direction 7 while being supported by the inclined surface 113. At a right-side end portion of the first frame 56, there is disposed a lever 58 so as to extend upright from a bottom surface of the first frame 56. The lever 58 extends into a reciprocating movement range of the carriage 38.

Figure 5A:
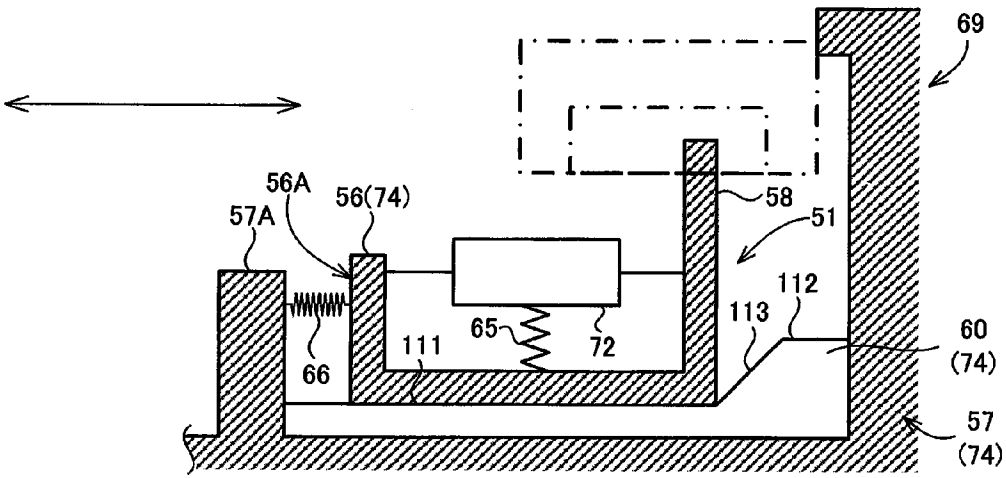
FIGS. 5A and 5B are cross-sectional views schematically showing a structure of a lift-up mechanism 74, more specifically.
Figure 5A:
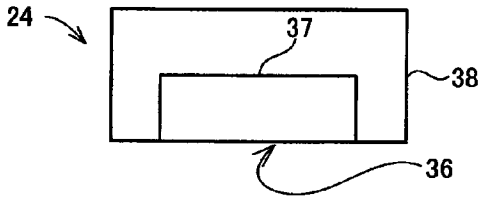
Figure 5A:
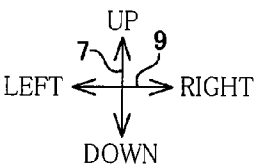
Figure 5B:
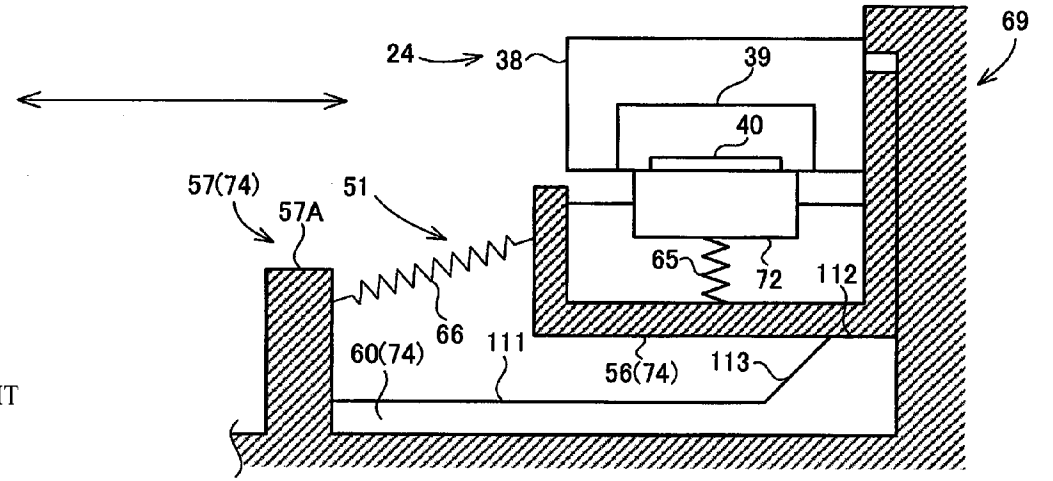
Figure 5B:
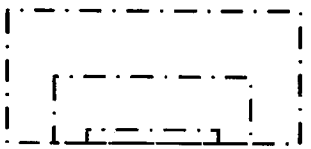
Figure 5B:
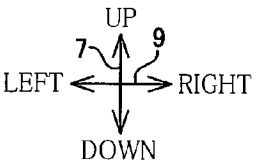

The cap 72 covers the nozzles of the recording head 37 as shown in FIG. 5B when the carriage 38 reaches a capping position over the purging mechanism 69 (indicated by the long dashed short dashed line in FIG. 5A). The cap 72 is supported by the first frame 56. In the present embodiment, the cap 72 is elastically supported in the up-and-down direction 7 by a coil spring 65 disposed between a lower portion of the cap 72 and the bottom surface of the first frame 56.

When the first frame 56 is being supported by the first guide surface 111 as shown in FIG. 5A, the cap 72 held by the first frame 56 takes a second posture in which the cap 72 is away from the nozzle surface 36 of the recording head 37. On the other hand, when the first frame 56 is being supported by the second guide surface 112 as shown in FIG. 5B, the cap 72 held by the first frame 56 takes a first posture in which the cap 72 is in contact with the recording head 37 to thereby cover the nozzle surface 36. That is, the posture of the cap 72 is selectively changed between the first posture and the second posture.

A coil spring 66 is attached between: a protruding portion 57A that protrudes from the second frame 57 on the left side of the first frame 56; and a left side surface 56A of the first frame 56. As shown in FIG. 5A, the coil spring 66 has a natural length when the first frame 56 is being supported by the first guide surface 111, namely, when the cap 72 takes the second posture. On the other hand, as shown in FIG. 5B, the coil spring 66 is expanded when the first frame 56 is being supported by the second guide surface 112, namely, when the cap 72 takes the first posture. In other words, in a state in which the cap 72 is in the first posture, the coil spring 66 elastically pushes the first frame 56 in a direction in which the posture of the cap 72 is changed from the first posture to the second posture.

When the carriage 38 moves in a direction toward the purging mechanism 69, namely, moves rightward in FIG. 5A, in the state shown in FIG. 5A, the lever 58 is pushed rightward by the carriage 38. By the rightward pushing force that acts on the lever 58, the first frame 56 slides rightward against the elastic force of the coil spring 66. Accordingly, the first frame 56 moves rightward along the guide surfaces, and the state of the first frame 56 is changed from the state in which the first frame 56 is supported by the first guide surface 111 to the state in which the first frame 56 is supported by the second guide surface 112 shown in FIG. 5B via the state in which the first frame 56 is supported by the inclined surface 113. That is, the posture of the cap 72 changes from the second posture to the first posture.

On the other hand, when the carriage 38 moves in a direction away from the purging mechanism 69, namely, moves leftward in FIG. 5B, in the state shown in FIG. 5B, and separates away from the lever 58, the first frame 56 slides leftward by the elastic force of the coil spring 66. Accordingly, the state of the first frame 56 changes from the state in which the first frame 56 is supported by the second guide surface 112 to the state in which the first frame 56 is supported by the first guide surface 111 shown in FIG. 5A via the state in which the first frame 56 is supported by the inclined surface 113. That is, the posture of the cap 72 changes from the first posture to the second posture.

<Board 80 and Controller 130>

As shown in FIG. 2, the board 80 is disposed on the upper surface of the frame 68 on the front side of the reciprocating movement range of the carriage 38. The board 80 includes a known printed substrate on which electronic components and so on are mountable. The controller 130 is configured to control operations of the MFD 10 and is constituted by a microcomputer and various electronic components mounted on the substrate.

Figure 6:
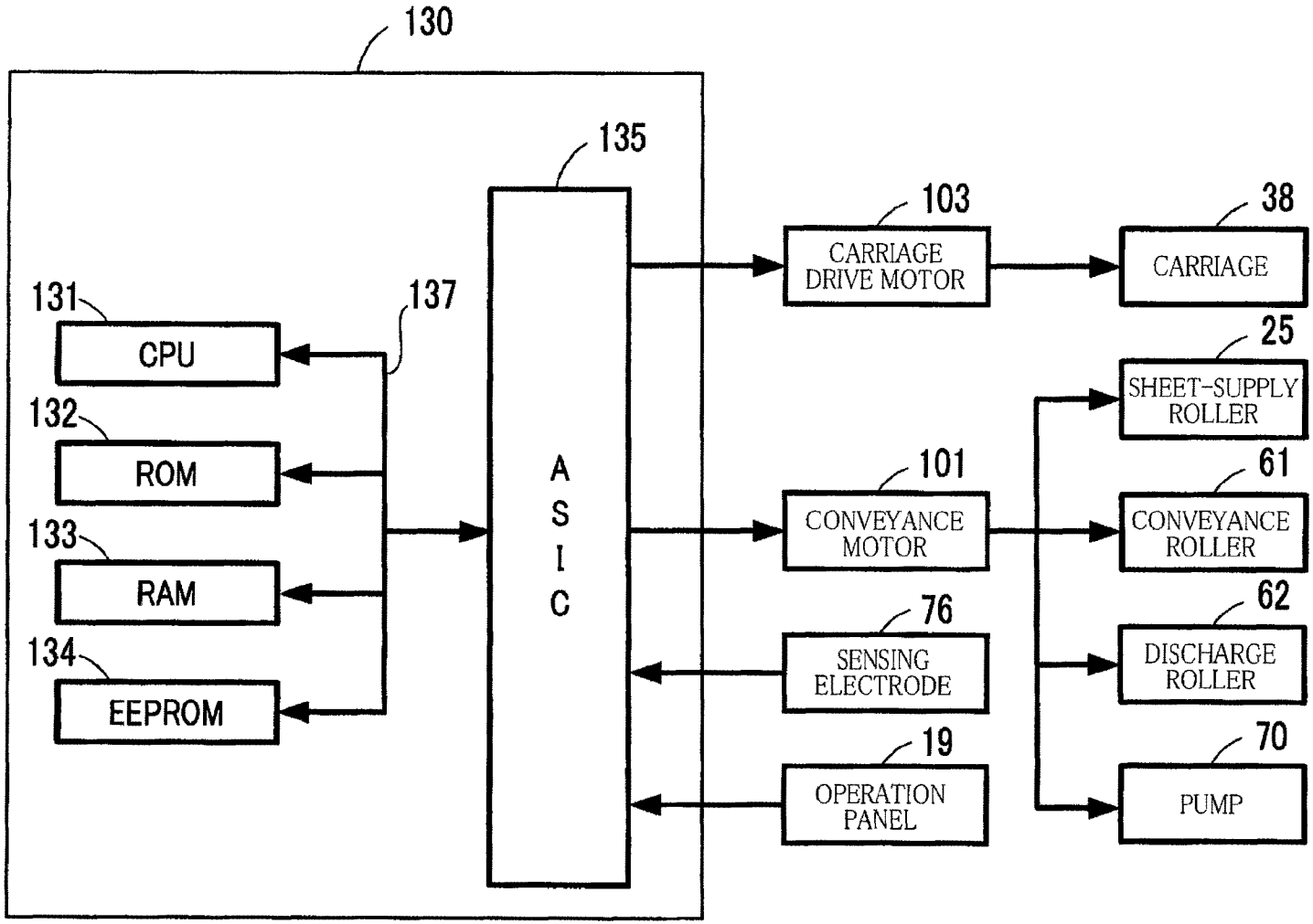
FIG. 6 is a block diagram showing a structure of a controller 130.

The controller 130 is configured to control overall operations of the MFD 10. The controller 130 executes processing according to flow charts that will be later explained, whereby the present invention is realized. As shown in FIG. 6, the controller 130 includes a CPU 131, a ROM 132, a RAM 133, an EEPROM 134, and ASIC 135. These are connected to one another via an internal bus 137.

The ROM 132 stores programs and so on according to which the CPU 131 controls various operations including a recording operation. The RAM 133 is used as a storage area for temporarily storing data, signals, and so on to be used when the CPU 131 executes the programs. The EEPROM 134 stores settings, flags, and so on which are to be kept after the MFD 10 is turned off. For instance, the EEPROM 134 (as one example of a storage of the invention) stores an ink discharge history (as one example of a discharge history of the invention) including cleaning details (as one example of discharge details of the invention) that will be later explained.

The conveyance motor 101 and the carriage drive motor 103 are connected to the ASIC 135. Drive circuits (not shown) for controlling the respective motors are incorporated in the ASIC 135. The CPU 131 outputs drive signals for respectively rotating the motors to the drive circuits corresponding to the respective motors. Each drive circuit outputs, to the corresponding motor, a drive current in accordance with the drive signal inputted from the CPU 131, so that the corresponding motor is rotated. That is, the controller 130 controls driving (rotation) of each of the motors 101, 103.

It is noted that the relationship between the constituent elements of the MFD 10 and the motors 101, 103 for driving the constituent elements is not limited to that illustrated in FIG. 6. For instance, the sheet-supply roller 25 and the pump 70 may be connected to one motor, and the conveyance roller 61 and the discharge roller 62 may be connected to another motor. Further, the sheet-supply roller 25 may be connected to one motor, the conveyance roller 61 and the discharge roller 62 may be connected to another motor, and the pump 70 may be connected to still another motor.

The sensing electrode 76 is connected to the ASIC 135. That is, the controller 130 judges an amount of the ink stored in the waste-liquid reservoir 71 based on the detection signal (the LOW level signal or the HIGH level signal) obtained from the sensing electrode 76. To be more specific, in an instance where the controller 130 receives the LOW level signal from the sensing electrode 76, the controller 130 judges that the ink does not yet reach the position of the sensing electrode 76 in the waste-liquid reservoir 71, namely, judges that a cumulative waste-liquid amount is not larger than the reference amount. On the other hand, in an instance where the controller 130 receives the HIGH level signal from the sensing electrode 76, the controller 130 judges that the ink has reached the position of the sensing electrode 76 in the waste-liquid reservoir 71, namely, judges that the cumulative waste-liquid amount has exceeded the reference amount.

The operation panel 19 is also connected to the ASIC 135. That is, the controller 130 obtains operations (instructions) from the user through the operation panel 19. For instance, the controller 130 obtains, from the user, an instruction to perform a cleaning operation that will be later explained through the operation panel 19.

<Cleaning Operation>

The controller 130 allows the cleaning operation (as one example of a discharge operation of the invention) for discharging the ink remaining in the recording head 37 to be performed at a prescribed discharge timing (as one example of a discharge timing of the invention). The cleaning operation includes the purging operation and a flushing operation. There are an instance in which one of the purging operation and the flushing operation is performed as the cleaning operation and an instance in which both of the purging operation and the flushing operation are performed as the cleaning operation. Hereinafter, both of those instances are referred to as the cleaning operation.

The purging operation will be first explained. The controller 130 controls the purging mechanism 69 to perform the purging operation. Initially, the controller 130 controls the carriage drive motor 103 to move the recording head 37 to a purging position (capping position). The controller 130 then drives the conveyance motor 101 to rotate the pump 70, whereby the ink in the nozzles is discharged to the waste-liquid reservoir 71 through the space between the cap 72 and the nozzle surface 36, the suction hole 75, and the pump tube 73.

The flushing operation will be next explained. The flushing operation is an operation in which the recording head 37 ejects the ink not for a recording purpose but for a cleaning purpose. The controller 130 controls the carriage drive motor 103 to move the recording head 37 to a flushing position (not shown) and controls the recording head 37 to eject the ink. The thickened ink with increased viscosity due to drying and so on is discharged from the nozzles by ejection by the recording head 37. The ink discharged from the nozzles is received by a waste-ink tray (not shown) disposed below the flushing position and is discharged to the waste-liquid reservoir 71 via the pump tube 73 or another flow passage. Like the purging position, the flushing position is located in a region of the conveyance passage 23 outside the sheet-passing region thereof. More specifically, the region in which the flushing position is provided is located at an end portion of the conveyance passage 23 in the left-and-right direction 9 through which the recording sheet does not pass. For instance, the purging position and the flushing position may be provided respectively on one side and the other side of the sheet-passing region of the conveyance passage 23 in the left-and-right direction 9.

<Control by Controller 130>

Figure 7:
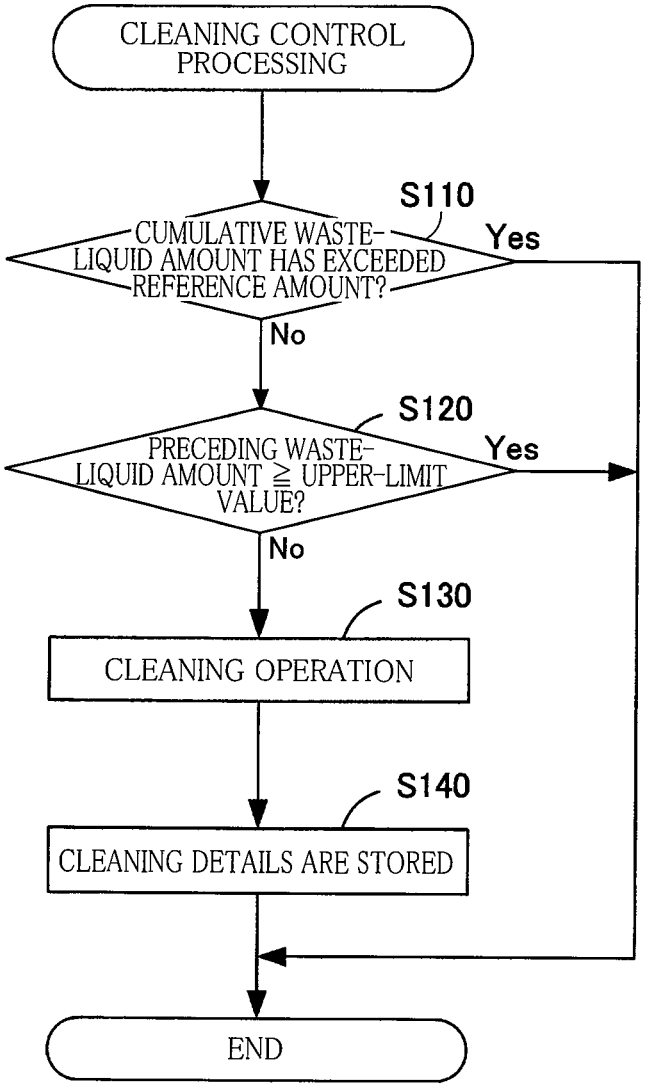
FIG. 7 is a flow chart of cleaning control processing according to one embodiment of the invention.

There will be hereinafter explained processing executed by the controller 130 for controlling the cleaning operation with reference to the flow charts of FIGS. 7-9. The cleaning control processing shown in FIG. 7 is executed by the controller 130 at every discharge timing. For instance, the discharge timing includes a timing at which the MFD 10 is turned on, a timing at which the image recording operation on a prescribed number of sheets has completed after a preceding purging operation, and a timing at which the user has instructed to perform the cleaning operation through the operation panel 19.

The controller 130 initially judges whether or not the cumulative waste-liquid amount has exceeded the reference amount in step S110. (Hereinafter, the "step" is omitted.) The instance in which the cumulative waste-liquid amount has exceeded the reference amount is an instance in which the waste-liquid reservoir 71 will soon become full, in other words, the amount of the ink in the waste-liquid reservoir 71 is getting close to a maximum amount that the waste-liquid reservoir 71 can store. The way of judging whether or not the cumulative waste-liquid amount has exceeded the reference amount is not particularly limited. For instance, every time the cleaning operation is performed, the controller 130 may store, in the EEPROM 134 and so on, a cumulation or a sum of ink amounts discharged in the cleaning operations, as the cumulative waste-liquid amount. The ink amount discharged in one cleaning operation is hereinafter referred to as a waste-ink amount or a waste-liquid amount where appropriate. The cumulative waste-liquid amount is reset at a timing when the waste-liquid reservoir 71 is replaced with new one. Alternatively, the controller 130 may judge that the cumulative waste-liquid amount has exceeded the reference amount as follows. That is, the controller 130 may count a number of times at which the cleaning operation has been performed after reception of the HIGH level signal from the sensing electrode 76 and may make the judgment at a timing when the count value becomes equal to a prescribed number of times (e.g., twice).

Where the controller 130 judges that the cumulative waste-liquid amount is not larger than the reference amount (S110: No), the controller 130 compares a preceding waste-liquid amount calculated in the processing according to FIGS. 8 and 9 and a prescribed upper-limit value (S120). The preceding waste-liquid amount is a sum of ink amounts discharged in the cleaning operations that have been performed in a specific time period ranging from a current discharge timing to a time point that precedes the current discharge timing by a time x. The time x is one example of a prescribed time of the invention. As the preceding waste-liquid amount, there may be used a value obtained by adding, to the preceding waste-liquid amount, the ink amount that is to be newly discharged in a current cleaning operation. A concrete method of calculating the preceding waste-liquid amount will be later explained with reference to FIGS. 8 and 9. The upper-limit value means an upper-limit value of an ink amount that the ink absorbing members 95 can absorb in the time x. It is noted, however, that the "upper-limit value" used herein may be the so-called limit value determined by the structure and so on of the ink absorbing members 95 or may be a value (smaller than the limit value) arbitrarily set for preventing the ink from overflowing from the ink absorbing members 95. It is further noted that the ink amount that the ink absorbing members 95 can absorb is referred to as an ink-absorption amount where appropriate.

Where the preceding waste-liquid amount is less than the upper-limit value (S120: No), the controller 130 allows the cleaning operation to be performed (S130). In a case where the purging operation is performed, for instance, the controller 130 drives the carriage drive motor 103 to move the carriage 38 to the capping position, thereby changing the posture of the cap 72 from the second posture to the first posture. Subsequently, the controller 130 drives the conveyance motor 101 to rotate the pump 70, so that the ink in the nozzles is discharged to the waste-liquid reservoir 71 through the space formed between the cap 72 and the nozzle surface 36, the suction hole 75, and the pump tube 73. On the other hand, in a case where the flushing operation is performed, the controller 130 drives the carriage drive motor 103 to move the carriage 38 to the flushing position. Subsequently, the controller 130 controls the recording head 37 to eject the ink not for the recording purpose but for the cleaning purpose.

Thereafter, the controller 130 stores, in the EEPROM 134 and so on, cleaning details of the cleaning operation performed in S130 (S140) as a part of the cleaning history and then ends the cleaning control processing. In the cleaning details, there are contained: the sort of the performed operation (such as only the purging operation, only the flushing operation, and both of the purging operation and the flushing operation); the discharge timing (such as an initiation time or an end time of execution of the cleaning control processing of FIG. 7 or an initiation time or an end time of the cleaning operation in S130); and the ink amount discharged in the cleaning operation in S130 (hereinafter referred to as the "waste-ink amount" or the "waste-liquid amount" where appropriate), and so on.

The waste-liquid amount that is the ink amount discharged in one cleaning operation may be obtained by measuring an amount of the ink passing through the pump tube 73 by means of a flow meter or the like. Alternatively, the waste-liquid amount may be obtained based on a predetermined ink amount that is discharged in one purging operation and/or in one flushing operation. Instead of storing or holding the absolute value of the waste-liquid amount in the cleaning details, the number of times at which the purging operation and the flushing operation were performed may be contained in the cleaning details. That is, waste-liquid information on the basis of which the waste-liquid amount can be estimated needs to be contained in the cleaning details.

On the other hand, where the controller 130 judges that the cumulative waste-liquid amount has exceeded the reference amount (S110: Yes) or the preceding waste-liquid amount has become equal to or larger than the upper-limit value (S120: Yes), the controller 130 ends the processing of FIG. 7 without allowing the cleaning operation to be performed, in other words, the controller inhibits the cleaning operation to be performed. In this instance, the controller 130 may notify the user that the waste-liquid reservoir 71 is full, through the operation panel 19, a speaker or the like (not shown).

Figure 8:
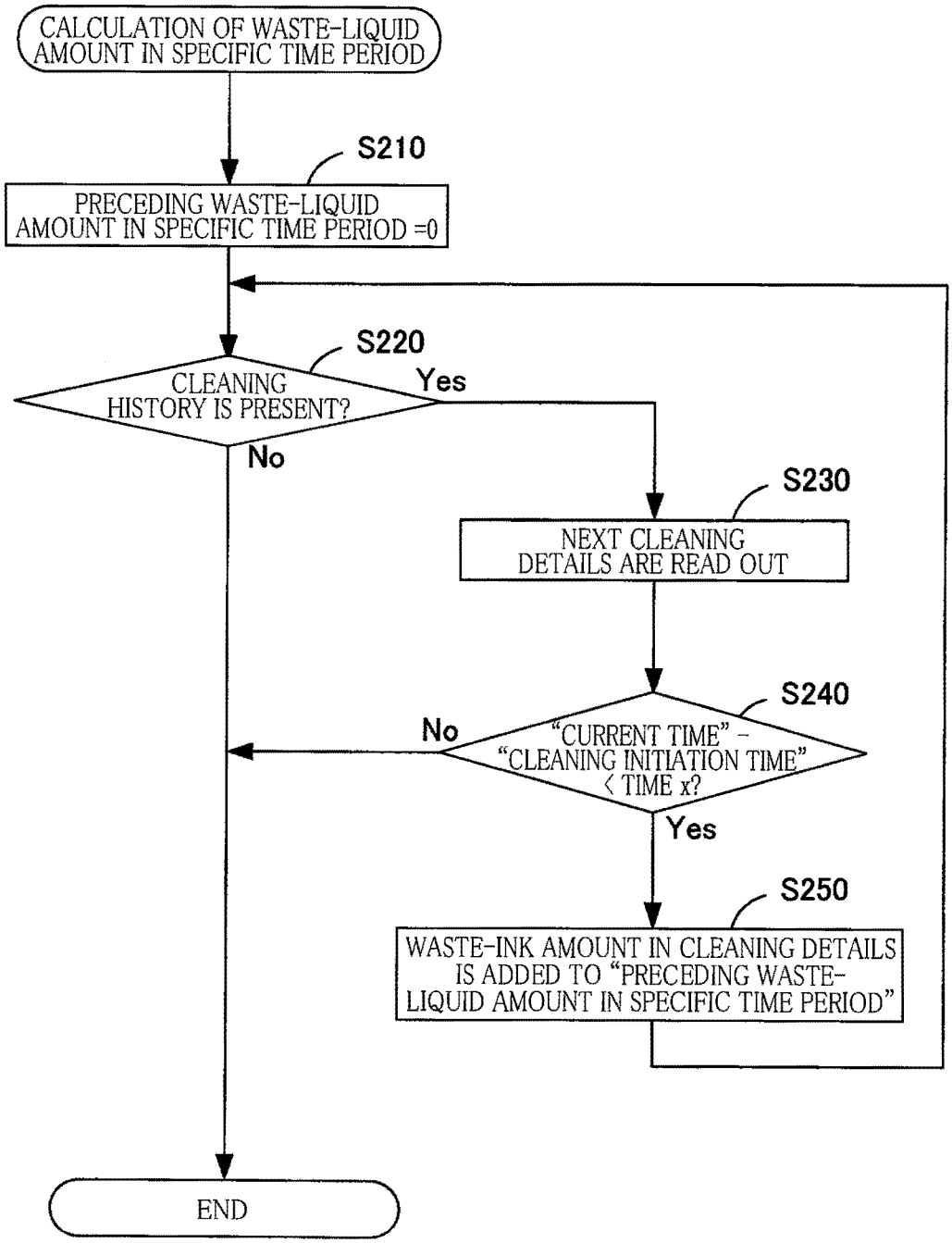
FIG. 8 is a flow chart showing a procedure for calculating a waste-liquid amount in a specific time period.

There will be next explained processing for calculating the preceding waste-liquid amount with reference to FIG. 8. This processing is executed immediately before execution of S120 of FIG. 7, for instance.

The controller 130 initially sets the preceding waste-liquid amount to 0 (S210). The controller 130 next confirms whether the cleaning history is stored or present in the EEPROM 134 (S220). Where the cleaning history is present in the EEPROM 134 (S220: Yes), the controller 130 reads the latest or the most recent cleaning details from the cleaning history stored in the EEPROM 134 (S230).

Subsequently, the controller 130 judges whether or not the discharge timing contained in the cleaning details read out in S230 falls within the specific time period ranging from the current discharge timing to the time point that precedes the current discharge timing by the time x (S240). In a case where the initiation time of the cleaning operation is contained in the cleaning details as one example of the discharge timing, for instance, the controller 130 may judge whether or not a value obtained by subtracting the initiation time of the cleaning operation from a current time is less than the time x. Where the discharge timing in the read cleaning details falls within the above-indicated specific time period (S240: Yes), the controller 130 adds the waste-ink amount contained in the cleaning details in question to the preceding waste-liquid amount (S250).

Thereafter, the controller 130 repeatedly executes the processing in S220-S250 for each cleaning details in reverse chronological order, namely, by going back, one by one, toward the oldest cleaning details stored as the cleaning history in the EEPROM 134 until the processing has been executed for all of the cleaning details stored in the EEPROM 134 (S220: No) or until the discharge timing in the read cleaning details falls outside the above-indicated specific time period (S240: No).

While not shown, there may be executed a step of adding the waste-liquid amount to be discharged in the current cleaning operation to the preceding waste-liquid amount after negative decision is made in S220 or after negative decision is made in S240. In the arrangement, the cleaning operation is suspended even in a case where the cumulative waste-liquid amount is getting very close to the upper-limit value of the ink amount that can be absorbed by the ink absorbing members 95. Accordingly, it is possible to prevent more effectively the ink leakage from the ink absorbing members 95.

Figure 9:
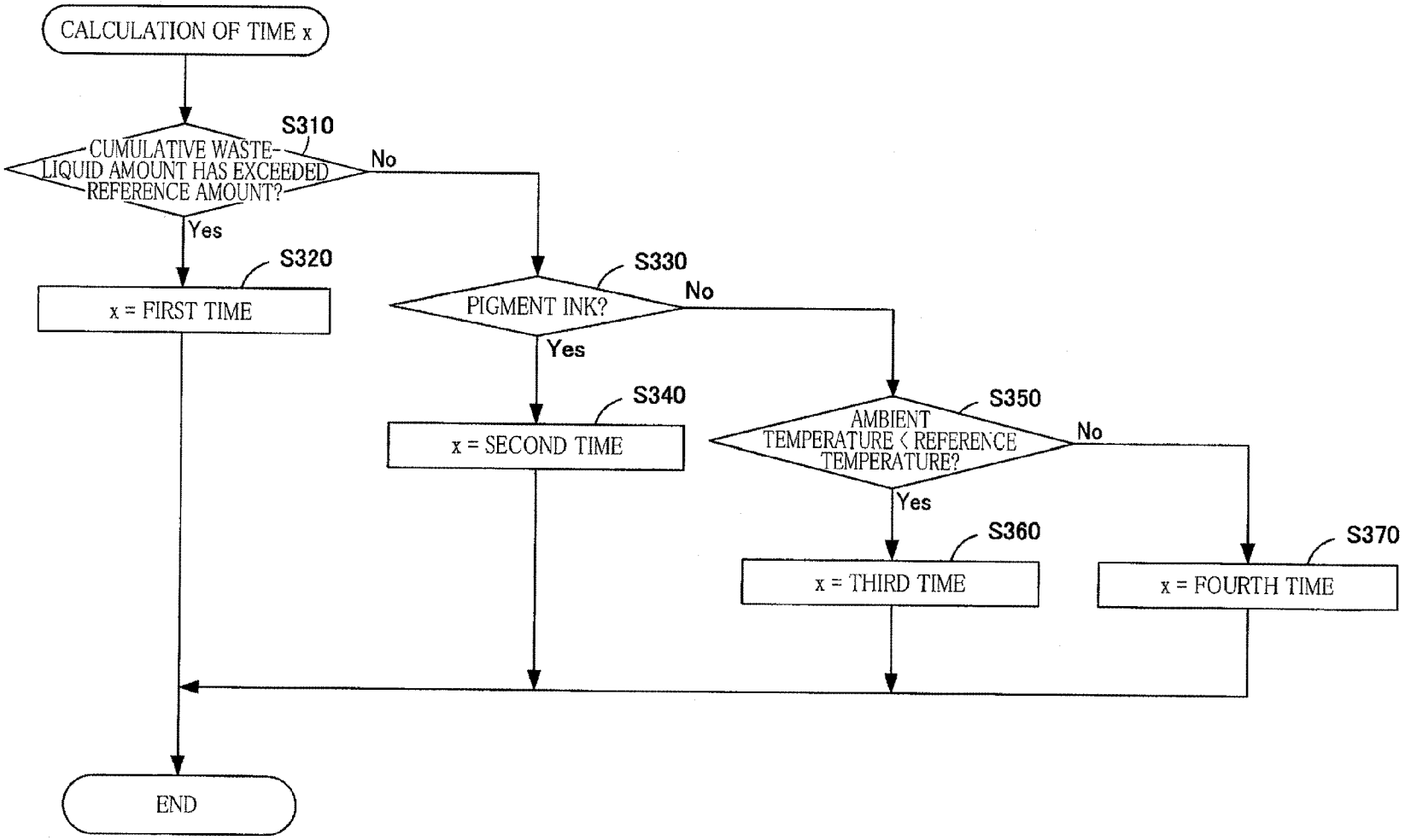
FIG. 9 is a flow chart showing a procedure for determining a time x.

Referring next to FIG. 9, there will be explained processing for calculating the time x on which calculation of the preceding waste-liquid amount is based. This processing is executed immediately before execution of the processing of FIG. 8, for instance. It is noted, however, that the processing of FIG. 9 may be omitted in an instance where the time x is set as a fixed time.

The controller 130 initially judges whether or not the cumulative waste-liquid amount has exceeded the reference amount (S310). Because this processing is common to the processing in S110 of FIG. 7, its explanation is dispensed with. Where the cumulative waste-liquid amount has exceeded the reference amount (S310: Yes), the controller 130 sets a first time as the time x (S320). The first time is longer than a time (a second time, a third time, or a fourth time) set when the cumulative waste-liquid amount is not larger than the reference amount (S310: No).

Where the cumulative waste-liquid amount is not larger than the reference amount (S310: Yes), the controller 130 judges whether the ink discharged in a previous (e.g., preceding) cleaning operation is a pigment ink (i.e., black ink) or a dye ink (i.e., cyan or magenta or yellow) (S330). Where the ink discharged in the previous cleaning operation is the pigment ink (S330: Yes), the controller 130 sets the second time as the time x (S340). The second time is shorter than the first time set when the cumulative waste-liquid amount has exceeded the reference amount and is longer than a time (the third time or the fourth time) set when the ink discharged in the previous cleaning operation is the dye ink. Where both of the pigment ink and the dye ink, namely, the inks of all colors, were discharged in the previous cleaning operation, the controller 130 may make affirmative decision in S330.

Where the ink discharged in the previous cleaning operation is the dye ink (S330: No), the controller 130 compares a temperature (i.e., ambient temperature) of a space in which the MFD 10 is disposed with a prescribed reference temperature (S350). Where the ambient temperature is lower than the reference temperature (S350: Yes), the controller 130 sets the third time as the time x (S360). The third time is shorter than the second time set when the ink discharged in the previous cleaning operation is the pigment ink and is longer than the fourth time set when the ambient temperature is not lower than the reference temperature.

On the other hand, where the ambient temperature is not lower than the reference temperature (S350: No), the controller 130 sets the fourth time as the time x (S370). The fourth time is shorter than the first time, the second time, and the third time.

The longer the time set as the time x, the larger the number of the cleaning details for which affirmative decision Yes is made in S240 of FIG. 8, whereby the preceding waste-liquid amount calculated in the processing of FIG. 8 tends to be increased. As a result, the longer the time that is set as the time x, the larger the preceding waste-liquid amount, so that the cleaning operation tends to be less likely to be performed in S130, where the upper-limit value in S120 of FIG. 7 is a fixed value.

When a large amount of the ink flows into the waste-liquid reservoir 71 at a time in the arrangement like the present embodiment wherein a part (the upper surface) of each ink absorbing member 95 is exposed outside the waste-liquid reservoir 71, there is a possibility that the ink that overflows the exposed portion of each ink absorbing member 95 flows outside the waste-liquid reservoir 71. According to the present embodiment, therefore, the waste-liquid amount in the specific time period ranging from the current time (the current discharge timing) to the time point that precedes from the current time (the current discharge timing) by the time x, namely, the preceding waste-liquid amount, is compared with the absorbing ability of the ink absorbing members 95 (i.e., the upper-limit value). Where the result of the comparison indicates a possibility that the waste ink leaks from the ink absorbing members 95, namely, when the preceding waste-liquid amount becomes equal to or larger than the upper-limit value, the cleaning operation is not performed at the discharge timing in question. Consequently, it is possible to prevent the ink from overflowing the ink absorbing members 95 due to frequently performed cleaning operations, for instance.

In the present embodiment, the length of the above-indicated specific time period on which calculation of the preceding waste-liquid amount is based, in other words, the time x, is variable depending upon various conditions. This is because the probability of occurrence of the ink leakage is considered to vary depending upon situations of the waste-liquid reservoir 71 and the ink even if the amount of the ink stored in the waste-liquid reservoir 71 is the same.

More specifically, the speed at which the ink that flows into the waste-liquid reservoir 71 permeates into the ink absorbing members 95 (hereinafter referred to as "permeation speed" where appropriate) is lower in an instance where the ink amount stored in the waste-liquid reservoir 71 is large than in an instance where the ink amount stored in the waste-liquid reservoir 71 is small. Therefore, it is preferable that the cleaning operation be less likely to be performed in the instance where the ink amount stored in the waste-liquid reservoir 71 is large. Similarly, the permeation speed is low in an instance where the ink previously discharged is the pigment ink, as compared with an instance where the ink previously discharged is the dye ink. Therefore, it is preferable that the cleaning operation be less likely to be performed in the instance where the ink previously discharged is the pigment ink. Similarly, the permeation speed becomes low with a decrease in the ambient temperature because the viscosity of the ink increases with a decrease in the ambient temperature. Therefore, it is preferable that the cleaning operation be less likely to be performed with a decrease in the ambient temperature. In this way, it is possible to more effectively prevent the ink from leaking from the waste-liquid reservoir 71. It is noted, however, that the ease with which the cleaning operation is performed is just the tendency and that there is a possibility that the ease with which the cleaning operation is performed is reversed in some cases.

Modified Embodiments

Figure 10:
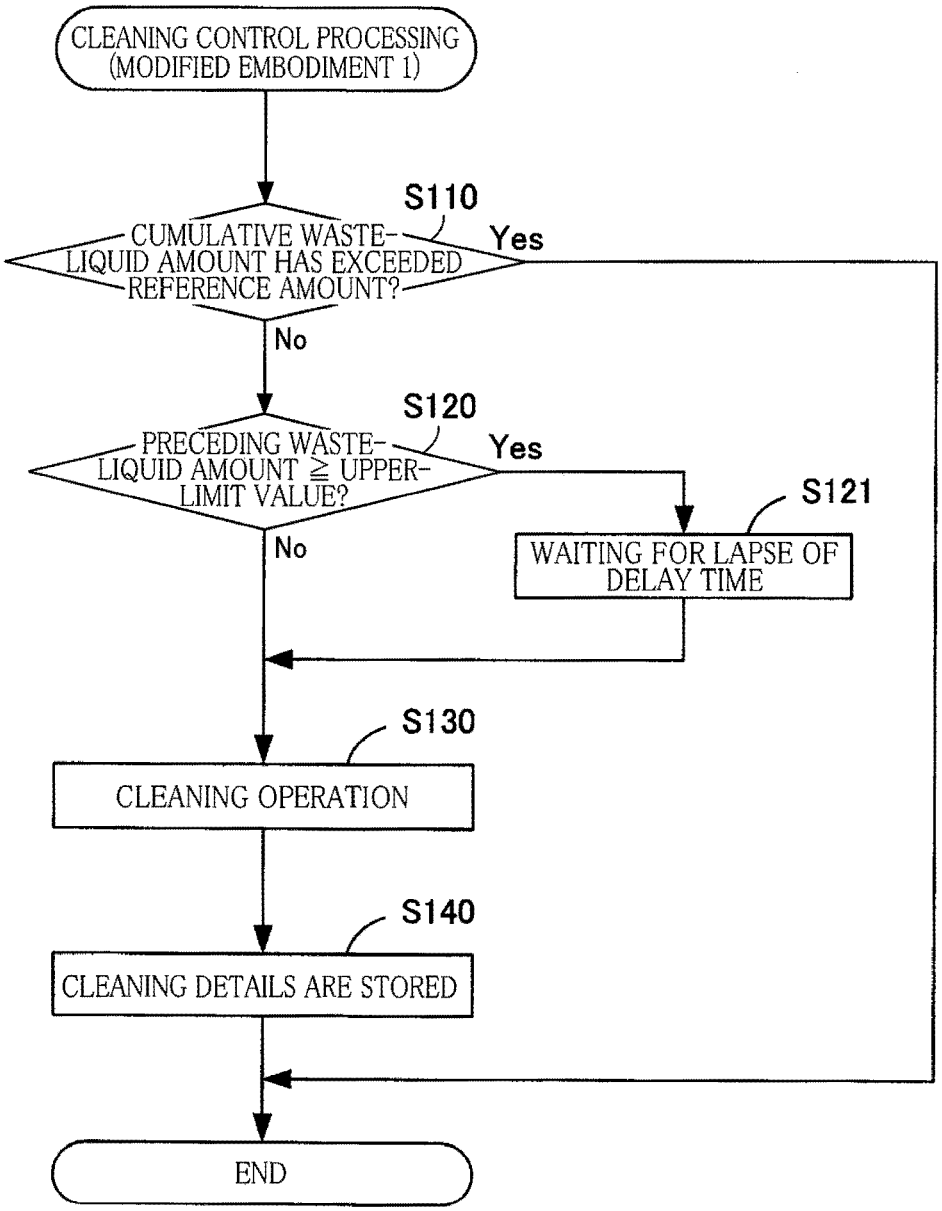
FIG. 10 is a flow chart of cleaning control processing according to a modified embodiment 1.
Figure 11:
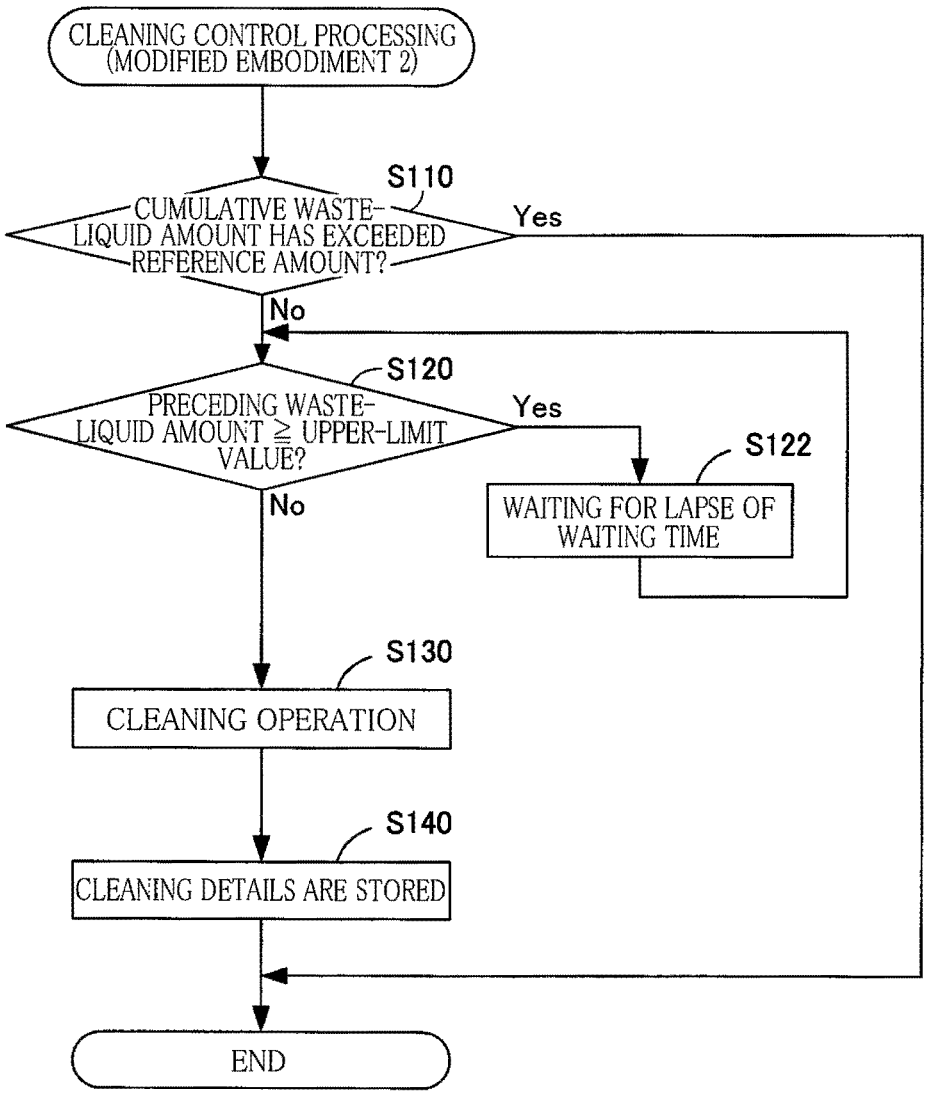
FIG. 11 is a flow chart of cleaning control processing according to a modified embodiment 2.
Figure 12:
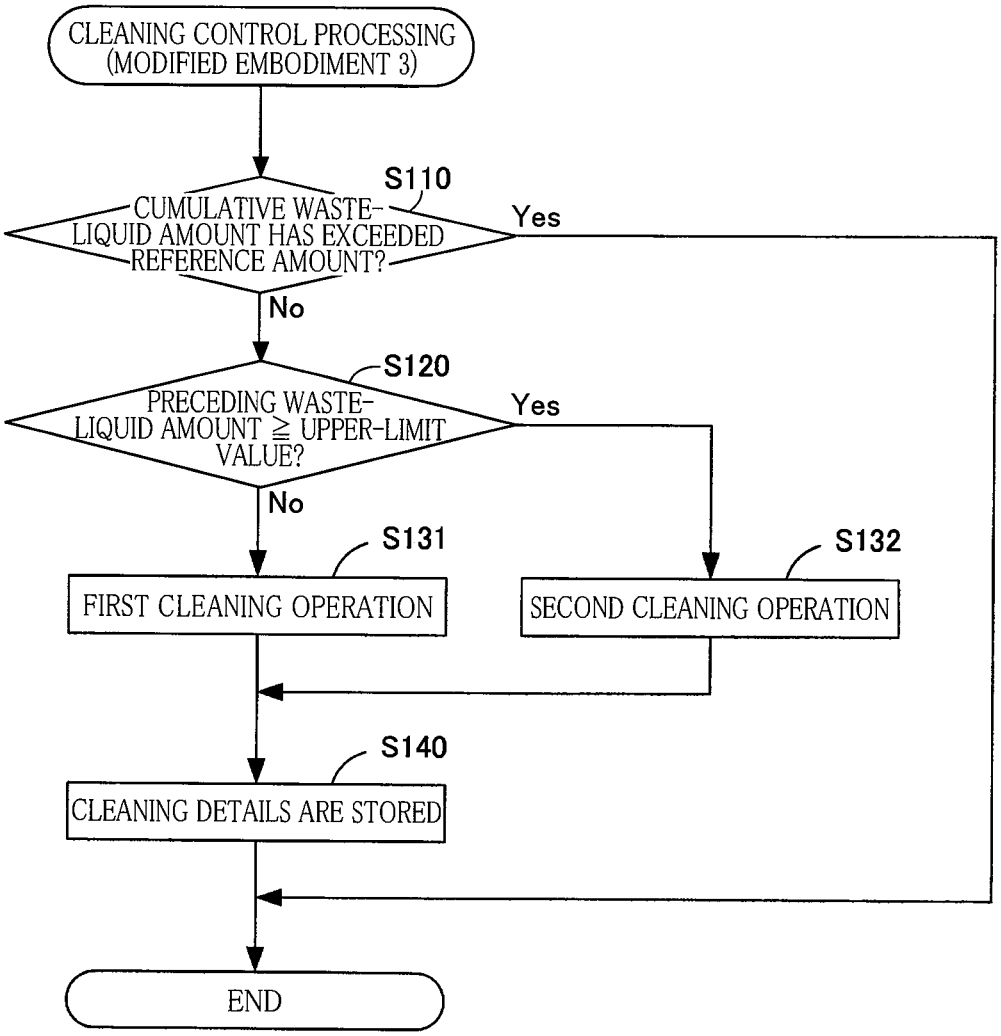
FIG. 12 is a flow chart of cleaning control processing according to a modified embodiment 3.

Referring next to FIGS. 10-12, there will be explained modified embodiments of the cleaning control processing shown in FIG. 7. It is noted that the same step numbers as used in FIG. 7 are assigned to common steps in FIGS. 10-12 and detailed explanation of the common steps is dispensed with. In the following explanation, only different steps will be mainly described.

Referring to FIG. 10, there will be explained cleaning processing according to a modified embodiment 1. In the above-described cleaning operation shown in FIG. 7, the controller 130 ends the processing without allowing the cleaning operation to be performed when the preceding waste-liquid amount becomes equal to or larger than the upper-limit value (S120: Yes). The cleaning processing shown in FIG. 10 according to the modified embodiment 1 differs from the processing shown in FIG. 7 in that the cleaning operation is performed (S130) after a lapse of a prescribed delay time (S121) from the current discharge timing when the preceding waste-liquid amount becomes equal to or larger than the upper-limit value (S120: Yes).

The delay time used in S121 may be a fixed value determined in advance or may be made variable according to a technique following the procedure shown in FIG. 9. To be more specific, the delay time in the instance where the cumulative waste-liquid exceeds the reference amount (S310: Yes) may be set to be longer than the delay time in the instance where the cumulative waste-liquid amount is not larger than the reference amount (S310: No). Further, the delay time in the instance where the ink discharged in the previous cleaning operation is the pigment ink (S330: Yes) may be set to be longer than the delay time in the instance where the ink discharged in the previous cleaning operation is the dye ink (S330: No). Moreover, the delay time in the instance where the ambient temperature in the vicinity of the MFD 10 is lower than the reference temperature (S350: Yes) may be set to be longer than the delay time in the instance where the ambient temperature in the vicinity of the MFD 10 is not smaller than the reference temperature (S350: No).

According to the modified embodiment 1, the cleaning operation at the current discharge timing is once cancelled, whereby the ink leakage from the ink absorbing members 95 can be prevented. Further, the cleaning operation is performed after a lapse of the delay time from the current discharge timing, whereby it is possible to prevent deterioration in the image recording quality of the MFD 10 due to non-execution of the cleaning operation till the next discharge timing. Moreover, where the delay time is made variable depending upon various conditions, it is possible to ensure good balance between prevention of the ink leakage and maintenance of high image recording quality.

Referring next to FIG. 11, there will be explained cleaning processing according to a modified embodiment 2. The cleaning processing according to the modified embodiment 2 differs from the processing shown in FIG. 7 in that, when the preceding waste-liquid amount becomes equal to or larger than the upper-limit value (S120: Yes), the preceding waste-liquid amount is again compared with the upper-limit value (S120) after a lapse of a prescribed waiting time (S122). Here, the controller 130 calculates a new preceding waste-liquid amount every time S120 is executed. That is, every time S120 is executed, the controller 130 executes the processing shown in FIG. 8 and updates the preceding waste-liquid amount.

According to the modified embodiment 2, the preceding waste-liquid amount is compared with the upper-limit value on a regular basis, namely, at every time point when the waiting time elapses. Accordingly, the cleaning operation is performed at a timing when the preceding waste-liquid amount becomes smaller than the upper-limit value, so that the risk of the ink leakage is removed. Hence, it is possible to prevent the ink leakage due to execution of the cleaning operation at an excessively earlier timing and to prevent deterioration in the image recording quality of the MFD 10 due to non-execution of the cleaning operation till the next discharge timing.

Referring next to FIG. 12, there will be explained cleaning processing according to a modified embodiment 3. The cleaning processing according to the modified embodiment 3 differs from the processing shown in FIG. 7 in that a first cleaning operation is performed (S131) when the preceding waste-liquid amount is smaller than the upper-limit value (S120: No) while a second cleaning operation is performed (S132) when the preceding waste-liquid amount becomes equal to or larger than the upper-limit value (S120: Yes).

The first cleaning operation and the second cleaning operation are common in that only the purging operation is performed or both of the purging operation and the flushing operation are performed. The first cleaning operation and the second cleaning operation differ from each other in an ink suction speed (as one example of a discharge speed of the invention) in the purging operation. More specifically, in the first cleaning operation, the purging operation is performed at a first speed. In the second cleaning operation, the purging operation is performed at a second speed lower than the first speed. The first speed may be equal to the suction speed in the cleaning operation in S130 of FIG. 7. The suction speed in the purging operation can be made variable by controlling a rotation speed of the conveyance motor 101, for instance. That is, the suction speed becomes lower by reducing the rotation speed of the conveyance motor 101 while the suction speed becomes higher by increasing the rotation speed of the conveyance motor 101.

According to the modified embodiment 3, the cleaning operation is always performed at every discharge timing, namely, the cleaning operation is not suspended, thereby minimizing deterioration in the image recording quality of the MFD 10 due to non-execution of the cleaning operation. Further, the suction speed in the purging operation is lowered when the preceding waste-liquid amount becomes equal to or larger that the upper-limit value, thereby preventing the ink from overflowing the ink absorbing members 95.

In the modified embodiment 3, the suction speed in the purging operation may be decreased with an increase in the preceding waste-liquid amount. This may be realized in any suitable way. For instance, the upper-limit value in S120 may be set in a plural number, and the suction speed may be changed for each of the upper-limit values. In this instance, the purging operation may be performed as follows, for instance. Where the preceding waste-liquid amount is smaller than a first upper-limit value, the purging operation may be performed at the first speed. Where the preceding waste-liquid amount is equal to or larger than the first upper-limit value and is smaller than a second upper-limit value (>the first upper-limit value), the purging operation may be performed at a second speed (<the first speed). Where the preceding waste-liquid amount is equal to or larger than the second upper-limit value, the purging operation may be performed at a third speed (<the second speed). Further, the lowest one of the plurality of suction speeds (e.g., the third speed in this arrangement) may be set to 0. The suction speed that is equal to 0 means that the purging operation is not performed. According to this arrangement, the higher the possibility of occurrence of the ink leakage, namely, the larger the preceding waste-liquid amount, the lower the speed at which the ink is discharged. It is therefore possible to more effectively prevent the ink leakage from the ink absorbing members 95.

In S120 in the illustrated embodiment and the modified embodiments 1-3, the controller 130 is configured to judge whether or not the cleaning operation is allowed to be performed by comparing the preceding waste-liquid amount with the upper-limit value. Instead, the controller 130 may be configured to calculate an interval between the current discharge timing (i.e., the current time) and an immediately preceding discharge timing which immediately precedes the current discharge timing and at which the cleaning operation was performed. In this case, the controller 130 may allow the cleaning operation to be performed where the calculated interval is equal to or longer than the time x, and the controller 130 may inhibit the cleaning operation from being performed where the calculated interval is shorter than the time x.

It is noted that the illustrated embodiment and the modified embodiments 1-3 may be arbitrarily combined without departing from the spirit of the present invention.

What is claimed is:

1. An ink-jet recording apparatus, comprising:

a recording head configured to perform image recording by ejecting ink to a recording medium;

a discharge mechanism configured to perform a discharge operation for discharging the ink from the recording head;

an absorbing member configured to absorb the ink discharged by the discharge mechanism; and a controller configured to make a judgment as to whether or not to allow the discharge mechanism to perform the discharge operation every time a discharge timing comes and to control the discharge mechanism based on a result of the judgment;

wherein the controller is configured to:

calculate a waste-liquid amount in a specific time period from a current discharge timing to a time point that precedes by a prescribed time from the current discharge timing, the waste-liquid amount indicative of an amount of the ink discharged from the recording head in the discharge operation;

allow the discharge mechanism to perform the discharge operation when the calculated waste-liquid amount is smaller than an upper-limit value of an ink-absorption amount, in the specific time period, of the absorbing member; and inhibit the discharge mechanism from performing the discharge operation at the current discharge timing when the calculated waste-liquid amount becomes equal to or larger than the upper-limit value.

2. The ink-jet recording apparatus according to claim 1, wherein the controller allows the discharge mechanism to perform the discharge operation after a lapse of a prescribed delay time from the current discharge timing, when the waste-liquid amount in the specific time period becomes equal to or larger than the upper-limit value.

3. The ink-jet recording apparatus according to claim 2, wherein the controller is configured to set the delay time such that the delay time is longer in a case in which a cumulative waste-liquid amount exceeds a reference amount than in a case in which the cumulative waste-liquid amount is equal to or smaller than the reference amount, the cumulative waste-liquid amount being a cumulation of the waste-liquid amounts discharged in the discharge operations up to the current discharge timing.

4. The ink-jet recording apparatus according to claim 3, further comprising: an absorbing-member accommodator that accommodates the absorbing member; and a sensor disposed at a location within the absorbing-member accommodator at which the absorbing member is disposed and configured to output, to the controller, a detection signal indicating reaching of the ink to the location, wherein the controller is configured to judge that the cumulative waste-liquid amount has exceeded the reference amount by reception of the detection signal outputted from the sensor.

5. The ink-jet recording apparatus according to claim 2, wherein the controller is configured to set the delay time such that the delay time is longer in a case in which the ink is a pigment ink than in a case in which the ink is a dye ink.

6. The ink-jet recording apparatus according to claim 2, wherein the controller is configured to set the delay time such that the delay time is longer in a case in which a temperature of a space in which the ink-jet recording apparatus is disposed is lower than a reference temperature than in a case in which the temperature is equal to or higher than the reference temperature.

7. The ink-jet recording apparatus according to claim 1, wherein the controller compares the waste-liquid amount in the specific time period that is updated every time a prescribed waiting time elapses with the upper-limit value when the waste-liquid amount in the specific time period becomes equal to or larger than the upper-limit value and allows the discharge mechanism to perform the discharge operation when the waste-liquid amount in the specific time period that is updated becomes smaller than the upper-limit value.

8. The ink-jet recording apparatus according to claim 1, further comprising a storage, wherein the controller is configured to:

store, in the storage, discharge details as a part of a discharge history, the discharge details including the discharge timing and the amount of the ink discharged in the discharge operation at the discharge timing, every time the discharge mechanism performs the discharge operation; and calculate, as the waste-liquid amount in the specific time period, a total amount of the ink discharged in the discharge operations performed in the specific time period, among the amounts of the ink contained in the discharge history stored in the storage.

9. The ink-jet recording apparatus according to claim 1, further comprising a storage, wherein the controller is configured to:

store, in the storage, discharge details as a part of a discharge history, the discharge details including the discharge timing and the amount of the ink discharged in the discharge operation at the discharge timing, every time the discharge mechanism performs the discharge operation; and calculate, as the waste-liquid amount in the specific time period, a value obtained by adding an amount of the ink that is to be newly discharged in an instance where the discharging operation is performed at the current discharge timing, to a total amount of the ink discharged in the discharge operations performed in the specific time period, among the amounts of the ink contained in the discharge history stored in the storage.

10. The ink-jet recording apparatus according to claim 1, wherein the controller is configured to set the prescribed time such that the prescribed time is longer in a case in which a cumulative waste-liquid amount exceeds a reference amount than in a case in which the cumulative waste-liquid amount becomes equal to or smaller than the reference amount, the cumulative waste-liquid amount being a cumulation of the amounts of the waste-liquid discharged in the discharge operations up to the current discharge timing.

11. The ink-jet recording apparatus according to claim 10, further comprising: an absorbing-member accommodator that accommodates the absorbing member; and a sensor disposed at a location within the absorbing-member accommodator at which the absorbing member is disposed and configured to output, to the controller, a detection signal indicating reaching of the ink to the location, wherein the controller is configured to judge that the cumulative waste-liquid amount has exceeded the reference amount by reception of the detection signal outputted from the sensor.

12. The ink-jet recording apparatus according to claim 1, wherein the controller is configured to set the prescribed time such that the prescribed time is longer in a case in which the ink is a pigment ink than in a case in which the ink is a dye ink.

13. The ink-jet recording apparatus according to claim 1, wherein the controller is configured to set the prescribed time such that the prescribed time is set to be longer in a case in which a temperature of a space in which the ink-jet recording apparatus is disposed is lower than a reference temperature than in a case in which the temperature is equal to or higher than the reference temperature.

14. An ink-jet recording apparatus, comprising:

a recording head configured to perform image recording by ejecting ink to a recording medium;

a discharge mechanism configured to perform a discharge operation in which the ink is discharged from the recording head;

an absorbing member configured to absorb the ink discharged by the discharge mechanism; and a controller configured to make a judgment as to whether or not to allow the discharge mechanism to perform the discharge operation every time a discharge timing comes and to control the discharge mechanism based on a result of the judgment;

wherein the controller is configured to:

calculate a waste-liquid amount in a specific time period from a current discharge timing to a time point that precedes by a prescribed time from the current discharge timing, the waste-liquid amount indicative of an amount of the ink discharged from the recording head in the discharge operation;

allow the discharge mechanism to perform the discharge operation in which a discharge speed of the ink is set at a first speed when the calculated waste-liquid amount is smaller than an upper-limit value of an ink-absorption amount, in the specific time period, of the absorbing member; and allow the discharge mechanism to perform the discharge operation in which the discharge speed of the ink is set at a second speed lower than the first speed when the calculated waste-liquid amount becomes equal to or larger than the upper-limit value.

15. The ink-jet recording apparatus according to claim 14, wherein the controller is configured to set the second speed such that the second speed becomes lower relative to the first speed with an increase in the waste-liquid amount in the specific time period.

16. The ink-jet recording apparatus according to claim 14, further comprising a storage, wherein the controller is configured to:

store, in the storage, discharge details as a part of a discharge history, the discharge details including the discharge timing and the amount of the ink discharged in the discharge operation at the discharge timing, every time the discharge mechanism performs the discharge operation; and calculate, as the waste-liquid amount in the specific time period, a total amount of the ink discharged in the discharge operations performed in the specific time period, among the amounts of the ink contained in the discharge history stored in the storage.

17. The ink-jet recording apparatus according to claim 14, further comprising a storage, wherein the controller is configured to:

store, in the storage, discharge details as a part of a discharge history, the discharge details including the discharge timing and the amount of the ink discharged in the discharge operation at the discharge timing, every time the discharge mechanism performs the discharge operation; and calculate, as the waste-liquid amount in the specific time period, a value obtained by adding an amount of the ink that is to be newly discharged in an instance where the discharging operation is performed at the current discharge timing, to a total amount of the ink discharged in the discharge operations performed in the specific time period, among the amounts of the ink contained in the discharge history stored in the storage.

18. The ink-jet recording apparatus according to claim 14, wherein the controller is configured to set the prescribed time such that the prescribed time is longer in a case in which a cumulative waste-liquid amount exceeds a reference amount than in a case in which the cumulative waste-liquid amount becomes equal to or smaller than the reference amount, the cumulative waste-liquid amount being a cumulation of the amounts of the waste-liquid discharged in the discharge operations up to the current discharge timing.

19. The ink-jet recording apparatus according to claim 18, further comprising: an absorbing-member accommodator that accommodates the absorbing member; and a sensor disposed at a location within the absorbing-member accommodator at which the absorbing member is disposed and configured to output, to the controller, a detection signal indicating reaching of the ink to the location, wherein the controller is configured to judge that the cumulative waste-liquid amount has exceeded the reference amount by reception of the detection signal outputted from the sensor.

20. The ink-jet recording apparatus according to claim 14, wherein the controller is configured to set the prescribed time such that the prescribed time is longer in a case in which the ink is a pigment ink than in a case in which the ink is a dye ink.

21. The ink-jet recording apparatus according to claim 14, wherein the controller is configured to set the prescribed time such that the prescribed time is set to be longer in a case in which a temperature of a space in which the ink-jet recording apparatus is disposed is lower than a reference temperature than in a case in which the temperature is equal to or higher than the reference temperature.

22. An ink-jet recording apparatus, comprising:

a recording head configured to perform image recording by ejecting ink to a recording medium;

a discharge mechanism configured to perform a discharge operation in which the ink is discharged from the recording head;

an absorbing member configured to absorb the ink discharged by the discharge mechanism; and a controller configured to make a judgment as to whether or not to allow the discharge mechanism to perform the discharge operation every time a discharge timing comes and to control the discharge mechanism based on a result of the judgment;

wherein the controller is configured to allow the discharge mechanism to perform the discharge operation at a current discharge timing, when an interval between: the current discharge timing; and an immediately preceding discharge timing which immediately precedes the current discharge timing and at which the discharge operation was performed is shorter than a prescribed time.

* * * * *